US009977372B2

(12) United States Patent
Okuyama

(10) Patent No.: US 9,977,372 B2
(45) Date of Patent: May 22, 2018

(54) IMAGE FORMING APPARATUS

(71) Applicant: CANON KABUSHIKI KAISHA, Tokyo (JP)

(72) Inventor: Yuta Okuyama, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/496,052

(22) Filed: Apr. 25, 2017

(65) Prior Publication Data

US 2017/0315477 A1 Nov. 2, 2017

(30) Foreign Application Priority Data

May 2, 2016 (JP) ..... 2016-092669

(51) Int. Cl.

*G03G 15/095* (2006.01)
*G03G 21/10* (2006.01)
*G03G 21/20* (2006.01)

(52) U.S. Cl.

CPC ..... *G03G 15/095* (2013.01); *G03G 21/10* (2013.01); *G03G 21/105* (2013.01); *G03G 21/203* (2013.01)

(58) Field of Classification Search

CPC .... G03G 15/095; G03G 21/10; G03G 21/105; G03G 21/203

See application file for complete search history.

(56) References Cited

U.S. PATENT DOCUMENTS

2009/0148193 A1* 6/2009 Hatakeyama ..... G03G 15/0844 399/254
2014/0044465 A1* 2/2014 Mekada ..... G03G 21/105 399/358
2016/0033904 A1* 2/2016 Izumi ..... G03G 21/105 399/358

FOREIGN PATENT DOCUMENTS

JP H07-44077 A 2/1995
JP H11-38851 A 2/1999
JP H11-84970 A 3/1999
JP 2002-372898 A 12/2002
JP 2007-017544 A 1/2007

(Continued)

OTHER PUBLICATIONS

Machine translation of reference Tanaka (JP Pub No. 2015-118,230 A) Pub Date Jun. 25, 2015.*
Yuta Okuyama, U.S. Appl. No. 15/429,456, filed Feb. 10, 2017.

*Primary Examiner* — Rodney Bonnette
(74) *Attorney, Agent, or Firm* — Fitzpatrick, Cella, Harper & Scinto

(57) ABSTRACT

An image forming apparatus includes an image bearing member, a developing device which is configured to store developer having magnetic carrier and toner and to develop an electrostatic latent image formed on the image bearing member, and a discharge port which is arranged in the developing device and through which developer is discharged from the developing device. A collection portion is configured to collect the developer discharged through the discharge port, and a discharge conveyance portion is configured to convey the developer discharged through the discharge port to the collection portion. An environment detector is arranged in a conveyance passage of the discharge conveyance portion and is configured to detect environment information, and an adjustment portion is config- (Continued)

ured to adjust a development condition of the developing device based on output of the environment detector.

7 Claims, 10 Drawing Sheets

(56) References Cited

FOREIGN PATENT DOCUMENTS

| | | | |
|---|---|---|---|
| JP | 2007-065581 | A | 3/2007 |
| JP | 2010-122537 | A | 6/2010 |

* cited by examiner

IMAGE FORMING APPARATUS

BACKGROUND OF THE INVENTION

Field of the Invention

The present invention relates to an image forming apparatus of, for example, an electrophotographic type or an electrostatic recording type.

Description of the Related Art

Hitherto, an image forming apparatus of an electrophotographic type has been used for a wide variety of applications such as a copying machine, a printer, a plotter, a facsimile, and a multifunction peripheral having a plurality of functions of those. In the image forming apparatus of this type, charged toner is caused to approach an image bearing member in a developing device. Then, the toner is caused to electrostatically adhere to an electrostatic latent image formed on the image bearing member. With this, development is performed, and an image is formed. In the process of image formation, the toner is charged through frictional charging. Thus, frictional charge amount changes depending on environment such as temperature or humidity. The change in charge amount of toner may cause a change in amount of toner developed on the image bearing member, with the result that image density becomes more unstable.

In order to solve the above-mentioned problem, there has been proposed a technology of arranging an environment sensor in an image forming apparatus and controlling a charge-up mode of increasing charge amount of toner in accordance with an elapsed time period from last image formation and a state of environment at that time (Japanese Patent Application Laid-Open No. 2002-372898). In this image forming apparatus, the environment sensor is arranged, for example, in a space which is outside the developing device and which has an environment different from that of developer. According to this image forming apparatus, the charge amount of toner is maintained within a desired range. With this, a change in developing characteristic due to the change in charge amount of toner can be prevented.

There has been proposed a technology of arranging an environment sensor in a developer container of a developing device, for directly measuring temperature and humidity of developer and controlling a rotation speed and a rotation time period of a stirring screw for developer in accordance with a result of the measurement (Japanese Patent Application Laid-Open No. 2007-65581). According to this image forming apparatus, the temperature and humidity of the developer is directly measured. With this, a state of the developer can be detected with higher accuracy, and the detection result can be fed back to the control.

According to the image forming apparatus of Japanese Patent Application Laid-Open No. 2002-372898, the environment sensor is arranged in the space which is outside the developing device and which has an environment different from that of the developer. The developer container structurally has less portion to be exposed to ambient air. Thus, there is a case where deviation in environment occurs between an inside of the developer container and each of portions located outside the developer container in the image forming apparatus. For example, when the developing device is driven, self-temperature rise due to friction of developer may occur in the developing device. Thus, the temperature in the developer container becomes higher than temperature outside, and the relative humidity becomes lower. In this case, the detection result of the environment sensor arranged outside the developer container does not reflect the environment in the developer container with high accuracy. There is a fear in that the change in charge amount of toner cannot be obtained with high accuracy through the control based on the environment sensor, with the result that image formation with inappropriate density is performed.

According to the technology disclosed in Japanese Patent Application Laid-Open No. 2007-65581, the environment sensor is arranged in the developer container. Thus, every time a cartridge of the developing device is replaced, the environment sensor is also replaced.

SUMMARY OF THE INVENTION

The present invention has an object to provide a developing device which is capable of reducing replacement frequency of an environment sensor as compared to that of the developing device while having a configuration being capable of detecting environment of a developer.

According to one embodiment of the present invention, there is another object of providing an image forming apparatus, including: an image bearing member; a developing device which is configured to store developer having magnetic carrier and toner and to develop an electrostatic latent image formed on the image bearing member; a discharge port which is arranged in the developing device and through which developer is discharged from the developing device; a collection portion which is configured to collect the developer discharged through the discharge port; a discharge conveyance portion which is configured to convey the developer discharged through the discharge port to the collection portion; an environment detector which is arranged in a conveyance passage of the discharge conveyance portion and is configured to detect environment information; and an adjustment portion which is configured to adjust a development condition of the developing device based on output of the environment detector.

Further features of the present invention will become apparent from the following description of exemplary embodiments with reference to the attached drawings.

DESCRIPTION OF THE EMBODIMENTS

First Embodiment

Now, a first embodiment of the present invention is described in detail with reference to FIG. 1 to FIG. 7. In the first embodiment, description is made of a full-color printer of a tandem type as one example of an image forming apparatus 1. However, the present invention is not limited to the image forming apparatus 1 of the tandem type, and may be an image forming apparatus of another type. Further, the present invention is not limited to a full-color printer, and may be a monochromatic or mono-color printer. Alternatively, the present invention is applicable to various usages such as a printer, various types of printing machines, a copying machine, a facsimile, and a multifunction peripheral. In the first embodiment, the image forming apparatus 1 includes an intermediate transfer belt 44*b*. Toner images of respective colors are primarily transferred from photosensitive drums 51 onto the intermediate transfer belt 44*b*, and after that, a composite toner image of the toner images of respective colors is collectively and secondarily transferred onto a sheet S. However, the present invention is not limited to this, and may employ a method of directly transferring the toner images from the photosensitive drums to a sheet conveyed by a sheet conveyance belt.

Figure 1:
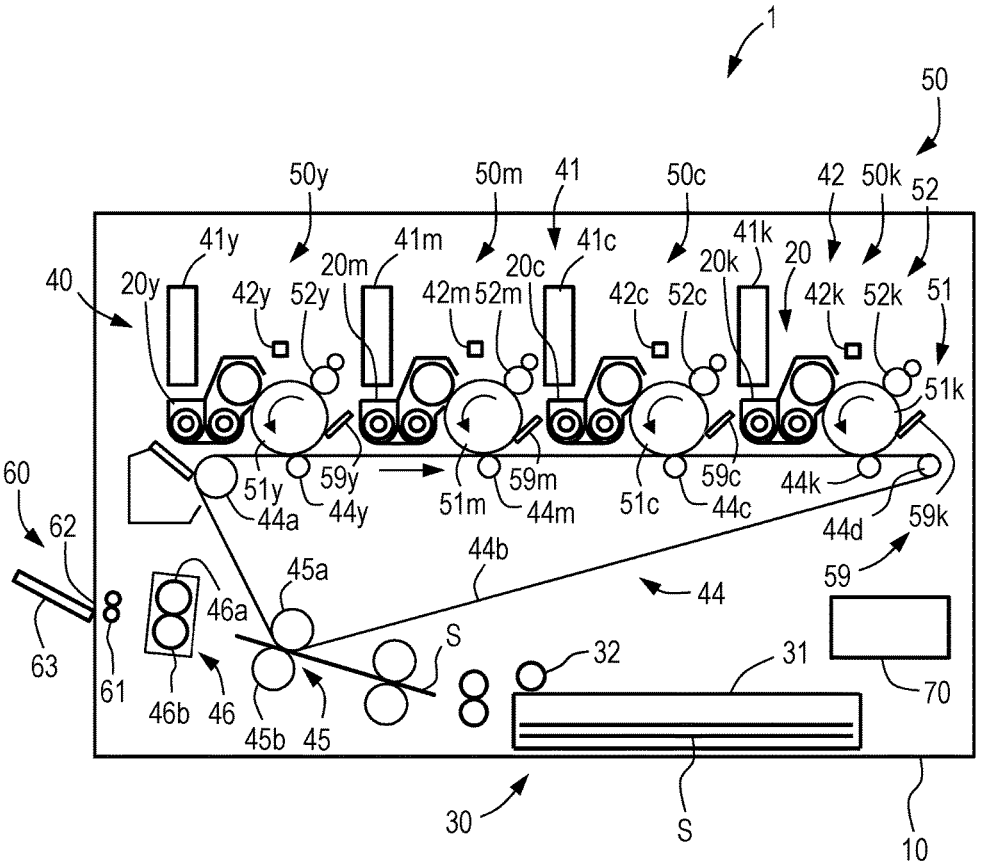
FIG. 1 is a sectional view for illustrating a schematic configuration of an image forming apparatus according to a first embodiment of the present invention.

As illustrated in FIG. 1, the image forming apparatus 1 includes an apparatus main body 10, a sheet feeding portion 30, an image forming portion 40, a sheet conveying portion (not shown), a sheet delivery portion 60, and a controller 70. A toner image is formed on the sheet S being a recording material. Specific examples of the sheet S include a normal sheet, a sheet made of synthetic resin as a substitute for the normal sheet, a thick sheet, and a sheet for an overhead projector.

The sheet feeding portion 30 is arranged in a lower portion of the apparatus main body 10. The sheet feeding portion 30 includes a sheet cassette 31, which is configured to stack and store the sheet S, and a feed roller 32, and is configured to feed the sheet S to the image forming portion 40.

The image forming portion 40 includes image forming units 50*y*, 50*m*, 50*c*, and 50*k*, toner bottles 41*y*, 41*m*, 41*c*, and 41*k*, exposure devices 42*y*, 42*m*, 42*c*, and 42*k*, an intermediate transfer unit 44, a secondary transfer portion 45, and a fixing portion 46. The image forming portion 40 is capable of forming an image on the sheet S based on image information. The image forming apparatus 1 according to the first embodiment is configured to support full-color printing, and the image forming units 50*y*, 50*m*, 50*c*, and 50*k* having the same configuration are separately arranged for respective four colors including yellow (y), magenta (m), cyan (c), and black (k). Therefore, in FIG. 1, the elements for four colors are denoted by the same reference symbols with identifiers for colors added thereto. However, in FIG. 2, FIG. 3, and the specification, there is a case where description is made only with the reference symbols without adding the identifiers for colors.

In the first embodiment, two-component developer, which is a mixture of non-magnetic toner and magnetic carrier with negative charge, is used as the developer. The toner is formed by incorporating pigment and wax into resin such as polyester or styrene and then powdering or polymerizing the same. The carrier is formed by applying resin coating onto a surface layer of a core, which is formed of ferrite particles or is formed of resin particles of kneaded magnetic powder.

The image forming units 50 include the four image forming units 50*y*, 50*m*, 50*c*, and 50*k* configured to form toner images of four colors. Each image forming unit 50 includes a photosensitive drum (image bearing member) 51 on which a toner image is formed, a charging roller 52, a developing device 20, a regulation blade 59, and a discharging device 80 (see FIG. 2).

The photosensitive drum 51 has a photosensitive layer which is formed on an outer peripheral surface of an aluminum cylinder so as to have a negative charge polarity, and is rotated in a direction indicated by the arrow at a predetermined process speed (peripheral speed). The charging roller 52 is brought into contact with a surface of the photosensitive drum 51 so that a surface of the photosensitive drum 51 is uniformly charged. The electric potential at this time is referred to as a charge potential VD [V]. On the surfaces of the photosensitive drums 51 after charging, electrostatic images are formed by the exposure devices 42*y*, 42*m*, 42*c*, and 42*k* based on image information. The electric potential at the exposed portions at that time is referred to as an exposure potential VL [V]. The photosensitive drum 51 is rotated while bearing the formed electrostatic image, and the electrostatic image is developed by the developing device 20 with toner. Configurations of the developing device 20 and the discharging device 80 are described later in detail.

The developed toner image is primarily transferred to the intermediate transfer belt 44*b*. The electric charge on the surface of the photosensitive drum 51 is removed by a pre-exposure portion (not shown) after the primary transfer. The regulation blade 59 is arranged in contact with the surface of the photosensitive drum 51 to remove residues such as transfer residual toner which remain on the surface of the photosensitive drum 51 after the primary transfer. The residues removed by the regulation blade 59 are collected to a collection portion 11 (see FIG. 2).

The intermediate transfer unit 44 is arranged below the image forming units 50*y*, 50*m*, 50*c*, and 50*k*. The intermediate transfer unit 44 includes a plurality of rollers such as a driving roller 44*a*, a driven roller 44*d*, and primary transfer rollers 44*y*, 44*m*, 44*c*, and 44*k*, and the intermediate transfer belt 44*b* stretched around those rollers. The primary transfer rollers 44*y*, 44*m*, 44*c*, and 44*k* are arranged opposed to the photosensitive drums 51*y*, 51*m*, 51*c*, and 51*k*, respectively, and are brought into abutment against the intermediate transfer belt 44*b*.

A transfer bias having a positive polarity is applied to the intermediate transfer belt 44*b* by the primary transfer rollers 44*y*, 44*m*, 44*c*, and 44*k*. With this, the respective toner images having the negative polarity on the photosensitive drums 51*y*, 51*m*, 51*c*, and 51*k* are sequentially transferred to the intermediate transfer belt 44*b* in superimposition. With this, the intermediate transfer belt 44*b* moves while receiving the transferred toner images, which have been obtained through development of the electrostatic images on the surfaces of the photosensitive drums 51*y*, 51*m*, 51*c*, and 51*k* (image bearing members).

The secondary transfer portion 45 includes a secondary transfer inner roller 45*a* and a secondary transfer outer roller 45*b*. A secondary transfer bias having a positive polarity is applied to the secondary transfer outer roller 45*b*. With this, the full-color image formed on the intermediate transfer belt 44*b* is transferred to the sheet S. The fixing portion 46 includes a fixing roller 46*a* and a pressure roller 46*b*. The sheet S is nipped and conveyed between the fixing roller 46*a* and the pressure roller 46*b*. With this, the toner image transferred to the sheet S is heated and pressurized to be fixed to the sheet S.

The sheet delivery portion 60 includes a delivery roller pair 61, a delivery port 62, and a delivery tray 63. The delivery roller pair 61 is arranged downstream of a delivery passage. The delivery port 62 and the delivery tray 63 are arranged on a side portion of the apparatus main body 10. The delivery roller pair 61 is capable of feeding the sheet S, which has been conveyed from the delivery passage, through the nip portion and delivering the sheet S through the delivery port 62. The sheet S delivered through the delivery port 62 is stacked on the delivery tray 63.

The controller 70 is constructed by a computer, and includes, for example, a CPU, a ROM configured to store programs for controlling respective portions, a RAM configured to temporarily store data, and an input-output circuit configured to input and output a signal with respect to an outside. The CPU is a microprocessor configured to manage an entire control for the image forming apparatus 1, and is a main component of a system controller. The CPU is connected to the sheet feeding portion 30, the image forming portion 40, the sheet conveying portion, the sheet delivery portion 60, and an operation portion (not shown) through intermediation of the input-output circuit, and is configured to communicate signals with respective portions and control operations of the respective portions. A temperature and humidity sensor 83 (see FIG. 2) is connected to the controller 70. The controller 70 has a timer function, and associates a detection time with information such as a relative humidity obtained from the temperature and humidity sensor 83. The ROM has a nonvolatile memory, and stores image formation conditions including the relative humidity and the detection time. The CPU writes the image formation conditions to the ROM or reads the image formation conditions from the ROM for use. The controller 70 controls a developing bias based on the detection result from the temperature and humidity sensor 83.

Next, an image forming operation in the image forming apparatus 1 is described.

When the image forming operation is started, first, the photosensitive drum 51 is rotated so that the surface thereof is charged by the charging roller 52. Then, laser light is emitted to the photosensitive drum 51 by the exposure device 42 based on image information so that an electrostatic latent image is formed on the surface of the photosensitive drum 51. The toner adheres to the electrostatic latent image, and the electrostatic latent image is developed to form a visible toner image. Then, the toner image is transferred to the intermediate transfer belt 44*b*.

Concurrently with the toner image forming operation, the feed roller 32 is rotated to separate and feed an uppermost sheet S on the sheet cassette 31. Then, in synchronization with a timing of conveyance of the toner image on the intermediate transfer belt 44*b*, the sheet S is conveyed to the secondary transfer portion 45 through the conveyance passage. The image is transferred from the intermediate transfer belt 44*b* to the sheet S, and the sheet S is conveyed to the fixing portion 46. The unfixed toner image is heated and pressurized at the fixing portion 46 to be fixed to the surface of the sheet S. The sheet S is delivered by the delivery roller pair 61 through the delivery port 62 to be stacked on the delivery tray 63.

The developing device 20 is described in detail with reference to FIG. 2 and FIG. 3. The developing device includes a developer container 21 configured to store developer, a first conveyance screw 22, a second conveyance screw 23, a developing sleeve (developer bearing member) 24, and a regulation member 25. The developing device 20 is configured to store developer and develop the electrostatic image formed on the photosensitive drum 51. At a position opposed to the photosensitive drum 51, the developer container 21 has an opening 21*a* which exposes the developing sleeve 24. In the first embodiment, the developing sleeve 24 having a cylindrical shape is employed. However, the present invention is not limited thereto. For example, a flexible belt may be applied.

The developer container 21 has, at a substantially center portion thereof, a partition wall 27 which extends in a longitudinal direction. The developer container 21 is divided by the partition wall 27 into a developing chamber 21*b* and a stirring chamber 21*c* in a horizontal direction. The developer is stored in the developing chamber 21*b* and the stirring chamber 21*c*. The developing chamber 21*b* is configured to supply the developer to the developing sleeve 24. The stirring chamber 21*c* communicates with the developing chamber 21*b* and is configured to collect and stir the developer from the developing sleeve 24. The partition wall 27 between the developing chamber 21*b* and the stirring chamber 21*c* has, at both end portions thereof, two communication portions 27*a* and 27*b* to allow communication between the developing chamber 21*b* and the stirring chamber 21*c* to each other.

The first conveyance screw 22 is arranged in the developing chamber 21*b* so as to be substantially parallel to the developing sleeve 24 along an axial direction of the developing sleeve 24 and is configured to stir and convey the developer in the developing chamber 21*b*. The second conveyance screw 23 is arranged in the stirring chamber 21*c* so as to be substantially parallel to an axis of the first conveyance screw 22 and is configured to convey the developer in the stirring chamber 21*c* in a direction opposite to the conveyance direction of the first conveyance screw 22. That is, the developing chamber 21*b* and the stirring chamber 21*c* construct a circulation passage for developer to stir and convey the developer. The toner is stirred by the screws 22 and 23, with the result that the toner is caused to rub against the carrier and frictionally charged to the negative polarity. At an end portion of the second conveyance screw 23 on a downstream side in the conveyance direction, there is arranged a return screw 23*a* which is reversed in the conveyance direction. In the stirring chamber 21*c*, most of the developer conveyed from upstream is pushed back by the return screw 23*a* and conveyed through the communication portion 27*a* to the developing chamber 21*b*.

In the stirring chamber 21*c*, at an end portion on upstream in the conveyance direction of the developer, there is formed a supply port 28 which is opened upward. A hopper 41*a* of the toner bottle 41 is connected to the supply port 28. The toner supplied from the toner bottle 41 is supplied from the supply port 28 to the stirring chamber 21*c* through the hopper 41*a*. In the stirring chamber 21*c*, at an end portion on a downstream side in the conveyance direction of the developer, there is formed a discharge port 29 which is opened downward. The discharging device 80 is connected to the discharge port 29. Surplus developer in the stirring chamber 21*c* goes over the return screw 23*a* and is discharged through the discharge port 29 to the discharging device 80.

The developing sleeve 24 bears and conveys developer having non-magnetic toner and magnetic carrier to a developing region opposed to the photosensitive drum 51. The developing sleeve 24 is made of non-magnetic material such as aluminum or non-magnetic stainless steel. In the first embodiment, the developing sleeve 24 is made of aluminum. On an inner side of the developing sleeve 24, a roller-like magnet roller (magnetic field generating unit) 24*m* is fixed in a non-rotatable state with respect to the developer container 21. The magnet roller 24*m* has a plurality of magnetic poles N1, S1, N2, S2, and N3 on its surface.

The developer in the developing device 20 is borne on the developing sleeve 24 by the magnetic roller 24*m*. After that, a layer thickness of the developer on the developing sleeve 24 is regulated by the regulation member 25. The developer is conveyed to the developing region opposed to the photosensitive drum 51 through rotation of the developing sleeve 24. In the developing region, the developer on the developing sleeve 24 rises to form magnetic bristles. The magnetic bristles are brought into contact with the photosensitive drum 51. Through supply of toner to the photosensitive drum 51 in such a manner, the electrostatic latent image on the photosensitive drum 51 is developed to form a toner image. In order to improve the rate of supply of toner to the electrostatic latent image, a developing bias obtained through superimposition of a direct-current voltage Vdc [V] and an alternate-current voltage is typically applied to the developing sleeve 24.

A difference (VL-Vdc) between the direct-current voltage Vdc and the exposure potential VL is referred to as Vcont. The Vcont causes generation of an electric field for conveying the toner to an electrostatic latent image portion. A difference (Vdc-VD) between the direct-current voltage Vdc and the charge potential VD is referred to as Vback. As a force to be exerted on toner, the Vback causes generation of an electric field for drawing back the toner in a direction from the photosensitive drum 51 to the developing sleeve 24. This electric field is provided to restrain so-called fogging phenomenon in which the toner adheres to a non-latent image portion.

The developing device 20 employs a so-called trickle developing method of supplying toner and a small amount of carrier. By the trickle developing method, the carrier is continuously stirred in the course of image formation, thereby restraining degradation in charging performance of the carrier due to contamination of the surface of the carrier by external additive or toner. Supply toner containing new carrier at a predetermined ratio is supplied through the supply port 28. With this, the surplus developer in the developing device 20 is discharged through the discharge port 29 formed in the stirring chamber 21*c*.

Figure 2:
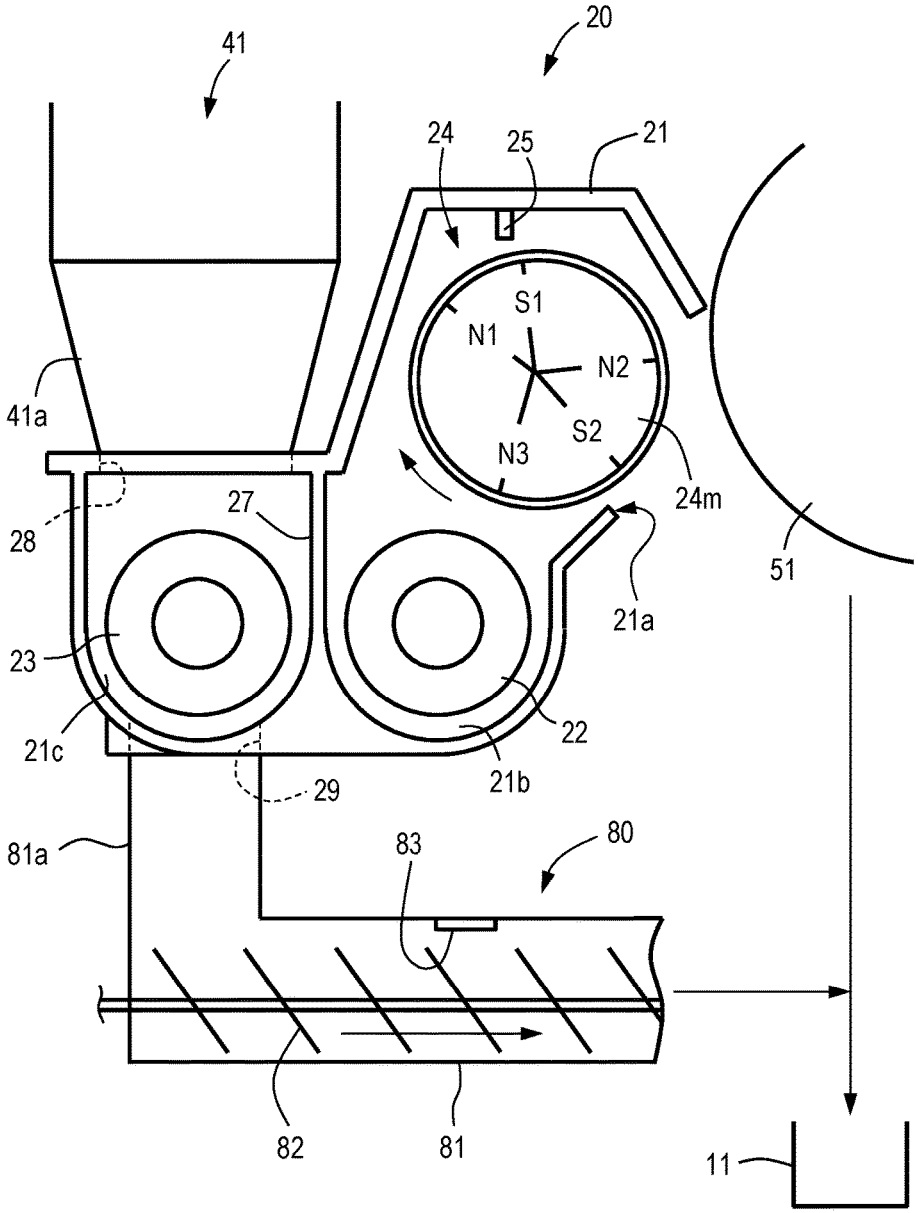
FIG. 2 is a sectional view for illustrating a schematic configuration of a developing device and a discharging device according to the first embodiment.
Figure 3:
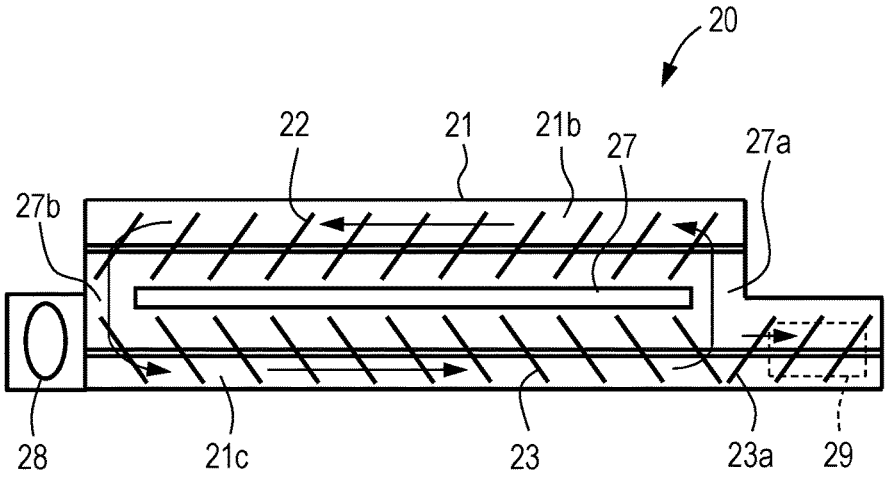
FIG. 3 is a plan view for illustrating a circulation passage of the developing device according to the first embodiment.

As illustrated in FIG. 2, the discharging device 80 includes a discharge pipe (discharge conveyance portion) 81, a discharge screw (conveyance member) 82, and a temperature and humidity sensor (environment detector) 83. The discharging device 80 conveys and discharges the surplus developer, which has been discharged from the developing device 20, to the collection portion 11.

The discharge pipe 81 is a pipe-like member which is arranged so as to be substantially horizontal from below the developing device 20 to above the collection portion 11. The discharge pipe 81 causes the surplus developer, which has been discharged from the developing device 20, to be conveyed inside the discharge pipe 81 (conveyance passage) to convey the surplus developer to the collection portion 11. At an end portion of the discharge pipe 81 on the developing device 20 side, there is formed a connection portion 81*a* connected to the discharge port 29 of the developing device 20. The discharge screw 82 is arranged inside the discharge pipe 81 and along the discharge pipe 81. The discharge screw 82 is rotated by a drive source (not shown). Through the rotation of the discharge screw 82, the surplus developer in the discharge pipe 81 is conveyed to the collection portion 11 side.

In the discharge pipe 81, the temperature and humidity sensor 83 detects environment information including at least humidity. In the first embodiment, the temperature and humidity sensor 83 is arranged on an upper wall portion of the discharge pipe 81, that is, above the discharge screw 82 in a vertical direction, and is typically mounted so as not to contact with the surplus developer. The mounting position of the temperature and humidity sensor 83 is not limited to the position above the discharge screw 82. In the first embodiment, a temperature and humidity sensor SHT1x series (manufactured by Sensirion AG Switzerland) is employed as the temperature and humidity sensor 83. However, the temperature and humidity sensor 83 is not limited thereto.

Figure 4A:
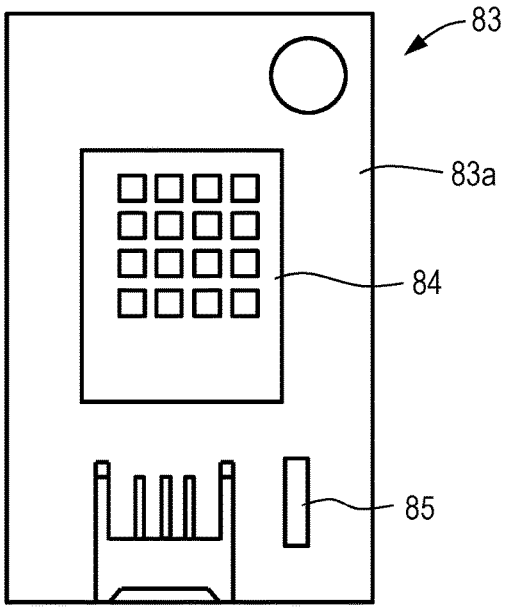
FIG. 4A is a front view for illustrating a temperature and humidity sensor according to the first embodiment.
Figure 4B:
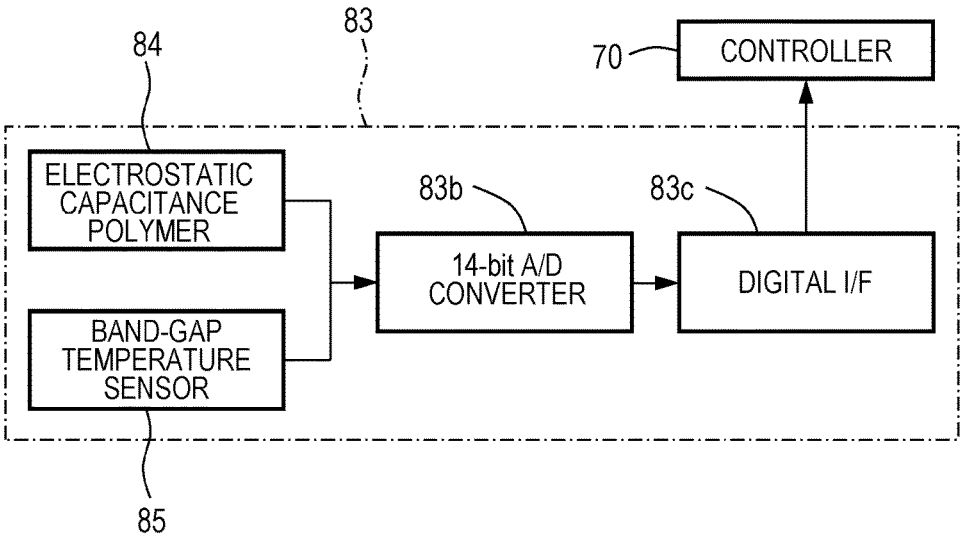
FIG. 4B is a block diagram for illustrating the temperature and humidity sensor according to the first embodiment.

As illustrated in FIG. 4A, in the temperature and humidity sensor 83, an electrostatic capacitance polymer 84 being a humidity detection device and a band-gap temperature sensor 85 being a temperature detection device are mounted to a mounting member 83*a*. The electrostatic capacitance polymer 84 being the humidity detection device uses a capacitor, which has polymer being a dielectric inserted thereto, as a sensing element. In this element, the amount of moisture adhering to the polymer changes along with a humidity change. As a result, the electrostatic capacitance of the capacitor changes. The humidity detection is performed with use of such a change in the electrostatic capacitance of the capacitor. The band-gap temperature sensor 85 being the temperature detection device uses a thermistor having a resistance value linearly changed with respect to the temperature, and calculates a temperature based on the resistance value. As illustrated in FIG. 4B, both the electrostatic capacitance polymer 84 and the band-gap temperature sensor 85 are coupled to a 14-bit A/D converter 83*b*, and are connected to the CPU of the controller 70 of the image forming apparatus through a digital interface 83*c*. Therefore, detection signals transmitted from the electrostatic capacitance polymer 84 and the band-gap temperature sensor 85 are received and processed by the controller 70.

In the developer container 21, there is less circulation of air with the outside. Thus, for example, driving of the developing device 20 may cause self-temperature rise in the developing device 20. Thus, there is a case where deviation in values of the temperature and humidity may occur between the inside and the outside of the developer container 21. However, in the first embodiment, the discharge pipe 81 having the temperature and humidity sensor 83 mounted thereto is placed outside the developing device 20 and communicates with the developer container 21 through the discharge port 29. Therefore, the atmosphere detected by the temperature and humidity sensor 83 well reflects the atmosphere in the developer container 21.

Figure 5A:
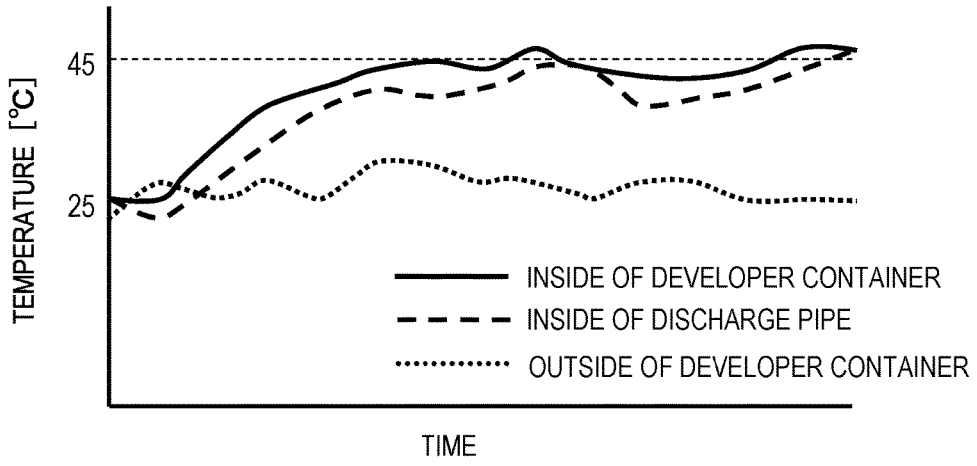
FIG. 5A is a graph for showing a time change in temperature at portions of the image forming apparatus according to the first embodiment.
Figure 5B:
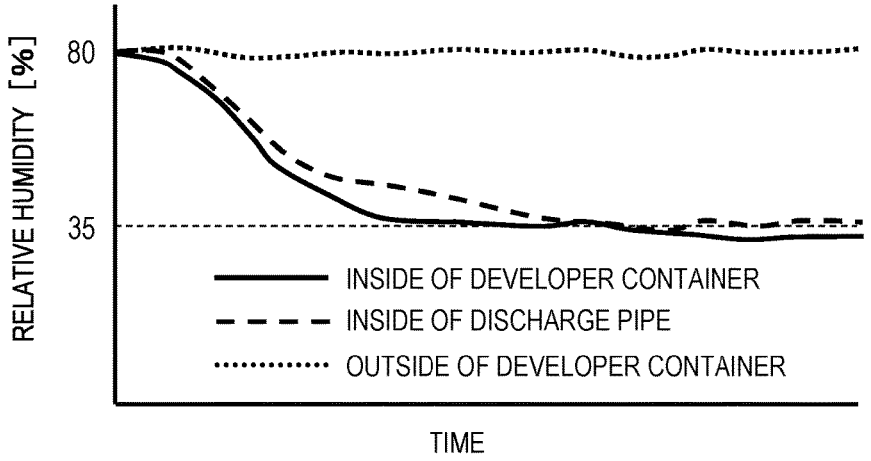
FIG. 5B is a graph for showing a time change in relative humidity at portions of the image forming apparatus according to the first embodiment.
Figure 6:
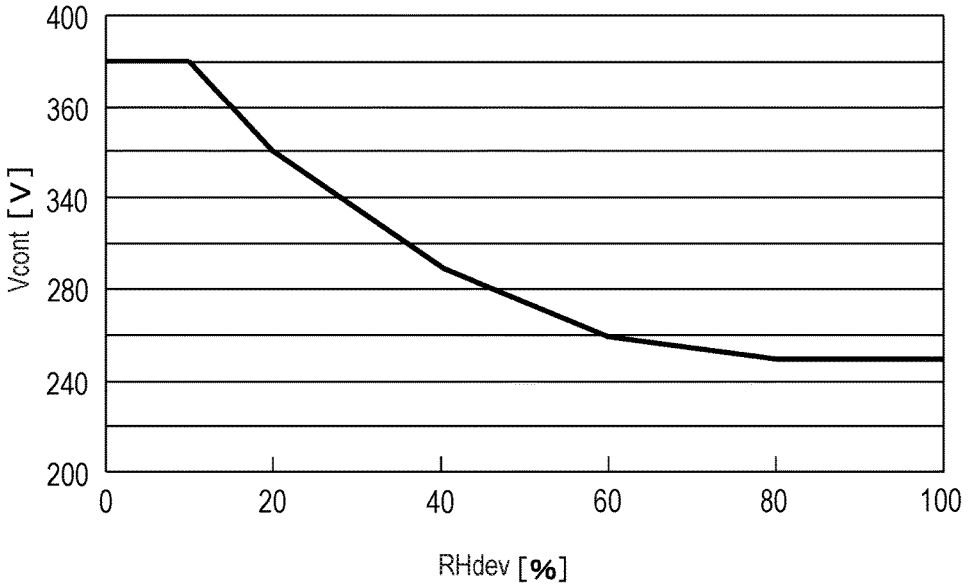
FIG. 6 is a graph for showing a relationship between a relative humidity RHdev and Vcont in the developing device according to the first embodiment.

In FIG. 5A and FIG. 5B, there are shown time changes in environment information as to the inside of the developer container 21 (solid line), the inside of the discharge pipe 81 (broken line), and the outside of the developer container 21 in the apparatus main body 10 (dotted line). In FIG. 5A, time changes in temperature are shown. In FIG. 5B, time changes in relative humidity are shown. As shown in FIG. 5A, when the developing device 20 is driven, the temperature inside the developer container 21 undergoes the self-temperature rise and becomes higher than the temperature outside the developer container 21. The atmosphere inside the discharge pipe 81 changes similarly to the temperature change inside the developer container 21. As shown in FIG. 5B, along with the self-temperature rise of the temperature inside the developer container 21, the relative humidity inside the developer container 21 and the relative humidity inside the discharge pipe 81 are reduced. Thus, the values of the temperature and humidity detected by the temperature and humidity sensor 83 in the first embodiment are similar to the values of temperature and humidity inside the developer container 21.

The temperature and humidity sensor 83 detects temperature and humidity of air inside the discharge pipe 81 reflecting the atmosphere inside the developer container 21, and are not temperature and humidity of the developer itself. In general, the changes in temperature and humidity of the developer is slower as compared to the changes in temperature and humidity of the ambient air. Therefore, in order to perform a control which deals with the temperature and humidity of the developer with higher accuracy, it is necessary to estimate temperature and humidity of the developer based on the detection values of the temperature and humidity sensor 83 rather than directly using the detection values as the temperature and humidity of the developer.

Information to be obtained through acquisition of the temperature and humidity of the developer is a change in charge amount of toner along with the change in temperature and humidity of the developer. It has been known that the charge amount of toner is dependent on humidity. However, whether the charge amount of the toner is dependent on the relative humidity or on the absolute humidity (absolute moisture amount) differs depending on a kind of developer. In the first embodiment, illustration is made of steps of the control in the case where the change in charge amount of the toner is dependent on the relative humidity. In this case, only a value of the relative humidity of the values of temperature and humidity detected by the temperature and humidity sensor 83 is used. Thus, it is not always necessary to detect the temperature. Therefore, a sensor configured to detect only the relative humidity may be used as the temperature and humidity sensor 83.

The temperature and humidity sensor 83 detects a relative humidity RH1 in the discharge pipe 81. Then, the CPU of the controller 70 detects a relative humidity RH0 used for previous image formation condition setting and a time t0 at that time, which are stored in the non-volatile memory. The controller 70 uses those information pieces and a current time t1 to calculate a current relative humidity RHdev of the developer in accordance with Expression (1) described below.

$$RHdev=(RH1-RH0)\times\exp\{-(t1-t0)/\beta\}+RH0 \quad (1)$$

In Expression (1), β is a time constant having a time dimension, and is a constant determined based on a configuration of the developing device 20 and various conditions, such as a physical property of the developer or the amount of developer, or is acquired through experiment. Larger β indicates that it takes a longer time period for the developer to have a humidity equal to an ambient humidity. A value of β in the configuration of the first embodiment is, for example, 500 (min).

According to Expression (1), the RHdev corresponds to RH0 immediately after the previous detection, that is, when (t1−t0) is 0. The RHdev corresponds to RH1 after an elapse of a sufficient time period from the previous detection, that is, when (t1−t0) tends to ∞. A humidity change between t0 and t1 is calculated by an exponential function at the first term on the right side. As described above, there is employed a method of calculating the relative humidity of the developer based on the temperature and humidity of the ambient air. Thus, it is preferred that the temperature and humidity sensor 83 be mounted at a location where the temperature and humidity sensor 83 is always prevented from being in contact with the developer. In the first embodiment, the temperature and humidity sensor 83 is arranged on the upper wall portion of the discharge pipe 81 where the temperature and humidity sensor 83 is typically prevented from being in contact with the surplus developer. Therefore, the relative humidity RHdev can be calculated with high accuracy.

It is conceivable that the relative humidity RHdev obtained through the calculation is fed back to, for example, a developer mixing condition or an image formation condition (Vcont). Herein, the relative humidity RHdev is fed back to the image formation condition, and a development condition is adjusted. An absolute value of the charge amount of the toner inside the developer container 21 tends to increase along with reduction in relative humidity. The amount of toner to be developed on the electrostatic latent image on the photosensitive drum 51 is determined based on a difference (i.e. Vcont) between the exposure potential VL and the direct-current voltage Vdc to be applied to the developing sleeve 24. When the charge amount of the toner is changed due to the humidity change, a magnitude of an electric potential generated by the toner of the same amount also changes. The magnitude Vt of the electric potential generated by the toner layer is expressed by Vt=Qt/C. Qt represents a charge amount of the toner, and C represents an electrostatic capacitance of the photosensitive drum 51. Accordingly, when an absolute value of the charge amount Qt of the toner increases along with the reduction in humidity, the electric potential Vt generated by the toner layer developed on the photosensitive drum 51 increases. The development is terminated when Vt=Vcont is satisfied. Thus, when the Vt increases, the amount to be developed is reduced at equal Vcont. That is, even when an absolute value of the toner charge amount increases, it is necessary to increase the toner laid-on level by increasing the Vcont in order to obtain a constant image density. In the first embodiment, a table for showing a relationship between the relative humidity RHdev and the Vcont (see FIG. 6) is prepared. In this table, when the relative humidity RHdev is smaller, that is, when an absolute value of the charge amount of the toner is larger, the Vcont is larger. The controller 70 (adjustment portion) can obtain the Vcont from the relative humidity RHdev using this table.

Figure 7:
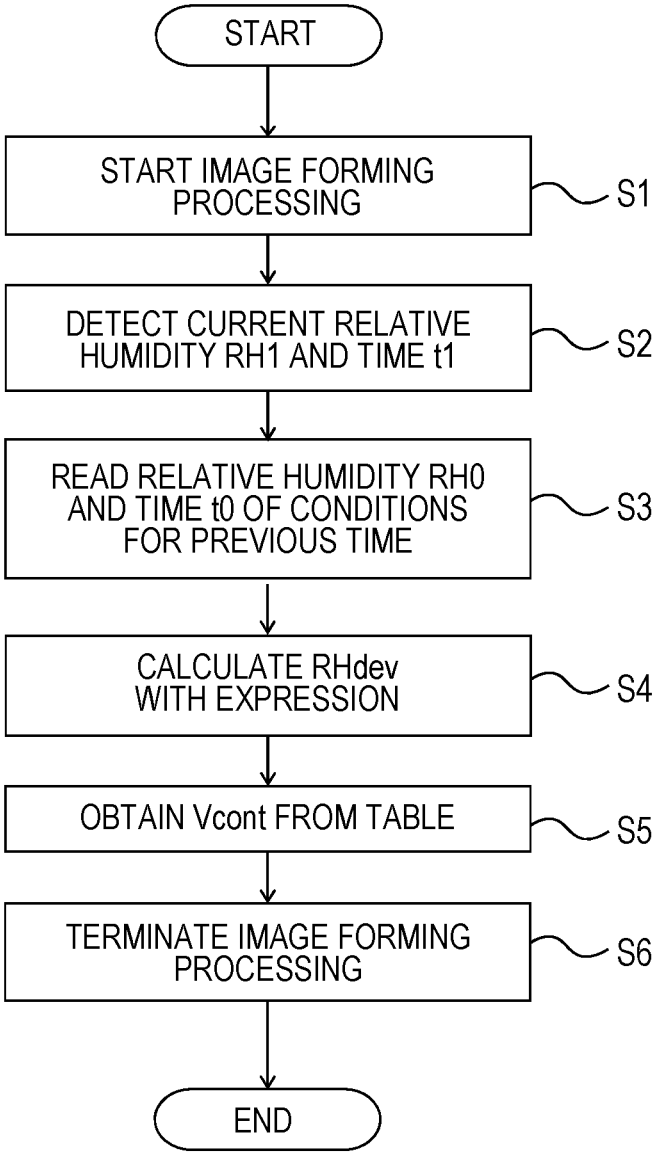
FIG. 7 is a flowchart for illustrating steps of processing for setting the Vcont by the developing device according to the first embodiment.

Steps for obtaining the Vcont through use of the developing device 20 are described with reference to the flowchart illustrated in FIG. 7. The controller 70 receives a command for image formation and causes the image forming apparatus 1 to start image forming processing (Step S1). Upon the start of the image forming processing, driving of the developing device 20 is started. The controller 70 detects the relative humidity RH1 inside the discharge pipe 81 from the temperature and humidity sensor 83 and obtains the detection time t1 (Step S2). Then, the controller 70 refers to the non-volatile memory, and reads the relative humidity RH0 and the time t0 of the conditions for the previous time (Step S3).

The controller 70 uses the relative humidity RH1, the time t1, the relative humidity RH0, and the time to, which have been obtained, to calculate the relative humidity RHdev with Expression (1) (Step S4). Then, the controller 70 refers to the table to obtain a value of the Vcont based on the relative humidity RHdev (Step S5). After that, the controller 70 terminates the image forming processing (Step S6).

The image forming apparatus 1 of the first embodiment includes the temperature and humidity sensor 83, which is configured to detect environment information including at least humidity inside the discharge pipe 81. Thus, the humidity of the surplus developer discharged from the developing device 20 can be detected with high accuracy. Therefore, without causing increase in cost due to replacement of the temperature and humidity sensor 83, the humidity related to the developer inside the developing device 20 can be detected with high accuracy. Further, density fluctuation along with the environment fluctuation is restrained, thereby being capable of achieving stable image formation.

Further, according to the image forming apparatus 1 of the first embodiment, the discharge pipe 81 to which the temperature and humidity sensor 83 is mounted is located outside the developing device 20. Thus, when the developing device 20 is replaced, the temperature and humidity sensor 83 remains in the apparatus main body 10. That is, even though the temperature and humidity sensor 83 is located at a position of remaining in the apparatus main body 10 at the time of replacement of the developing device 20, detection can be performed with high accuracy in reflection of the atmosphere inside the developer container 21.

Further, according to the image forming apparatus 1 of the first embodiment, the temperature and humidity sensor 83 is arranged on the upper wall portion of the discharge pipe 81 where the temperature and humidity sensor 83 is typically prevented from being in contact with surplus developer. Therefore, when the method of calculating the relative humidity of the developer based on temperature and humidity of ambient air is employed, degradation in detection accuracy due to contact with the developer may not occur, thereby being capable of calculating the relative humidity RHdev with high accuracy.

With regard to the image forming apparatus 1 according to the first embodiment, description is made of the case where the change in charge amount of toner is dependent on the relative humidity. However, the change in charge amount of toner is dependent not only to the relative humidity. The change in charge amount of toner may be dependent on the absolute humidity, depending on a kind of toner. Now, steps of the control to be executed in the case where the change in charge amount of toner is dependent on the absolute humidity are described as follows.

In this case, both information pieces of a temperature T1 [° C.] and the relative humidity RH1, which are detected by the temperature and humidity sensor 83, are used. The controller 70 calculates a weight absolute humidity AH [g/kg(DA)] based on the temperature T1 and the relative humidity RH1. The density fluctuation can be restrained by changing various process conditions through use of the obtained weight absolute humidity AH. The weight absolute humidity AH can be calculated by the following steps. First, a saturation vapor pressure $e(T_1)$ at the temperature T1 is calculated. The saturation vapor pressure $e(T_1)$ can be calculated with Expression (2) based on Tetens' formula.

$$e(T1)\ [\mathrm{Pa}]=611\times 10\hat{}(7.5\times T1/(T1+273.3)) \quad (2)$$

When vapor is assumed to be an ideal gas, and the expression is solved in accordance with a state equation of gas, a saturation weight absolute humidity M[g/kg(DA)] is calculated through use of Expression (3).

$$M=622\times e(T1)/(101300-e(T1)) \quad (3)$$

The relative humidity RH1 is obtained by dividing the weight absolute humidity AH by the saturation weight absolute humidity M. Thus, the weight absolute humidity AH can be calculated with Expression (4). The controller 70 can restrain the density fluctuation by changing the various process conditions through use of the obtained weight absolute humidity AH.

$$AH=RH1\times M \quad (4)$$

Second Embodiment

Figure 8:
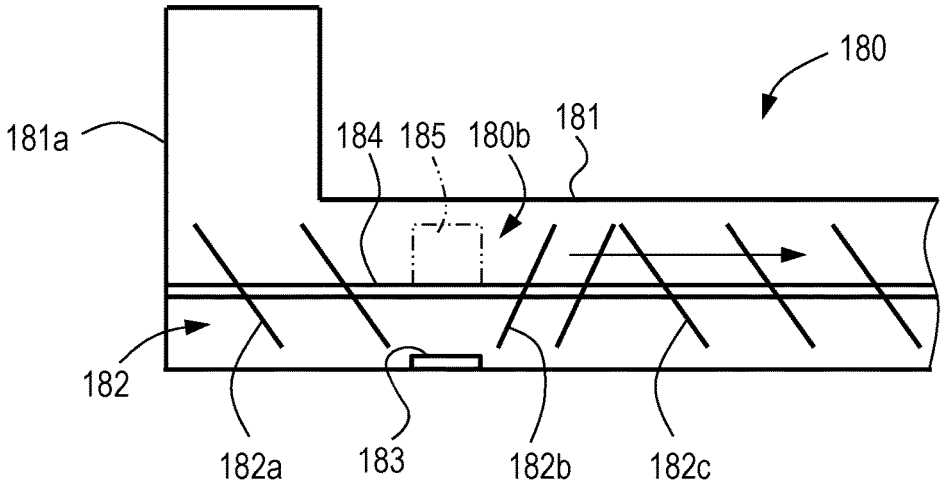
FIG. 8 is a sectional view for illustrating a schematic configuration of a discharging device according to a second embodiment of the present invention.
Figure 9:
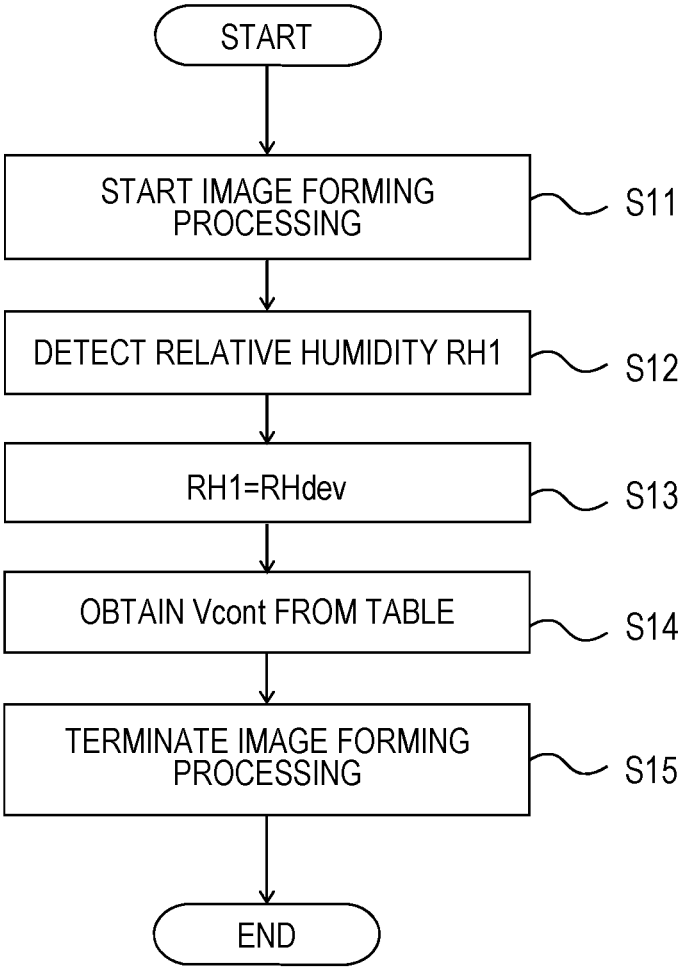
FIG. 9 is a flowchart for illustrating steps of processing for setting the Vcont by the developing device according to the second embodiment.

A second embodiment of the present invention is described in detail with reference to FIG. 8 and FIG. 9. The second embodiment is different from the first embodiment in that a discharge screw 182 of a discharging device 180 has a reverse conveyance portion 182*b* and in that a temperature and humidity sensor 183 is arranged below the discharge screw 182. Configurations other than those described above are the same as those of the first embodiment. Therefore, the same reference symbols are given, and description is omitted.

In the second embodiment, the discharge screw 182 includes a forward conveyance portion (first conveyance portion) 182*a* arranged directly below a connection portion 181*a*, a reverse conveyance portion (second conveyance portion) 182*b* arranged downstream of the forward conveyance portion 182*a* in the conveyance direction, and a forward conveyance portion 182*c* arranged downstream of the reverse conveyance portion 182*b* in the conveyance direction. An orientation of blades of the forward conveyance portion 182*a* is set so that surplus developer discharged from the connection portion 181*a* is conveyed in a conveyance direction (first direction) toward the collection portion 11 (see FIG. 2) as indicated by the arrow in FIG. 8. An orientation of blades of the reverse conveyance portion 182*b* is opposite to that of the blades of the forward conveyance portion 182*a* and is set so that the surplus developer is pushed back in an opposite direction (second direction) with respect to the conveyance direction. The forward conveyance portion 182*a* and the reverse conveyance portion 182*b* are arranged opposed to each other, and a detection region 180*b* is provided between the forward conveyance portion 182*a* and the reverse conveyance portion 182*b*.

The temperature and humidity sensor 183 is opposed to a region between the forward conveyance portion 182*a* and the reverse conveyance portion 182*b*, and is arranged below the discharge screw 182 in the vertical direction in the detection region 180*b*. The mounting position of the temperature and humidity sensor 183 is not limited to below the discharge screw 182.

The second embodiment has an object to detect a state of the developer with higher accuracy by contacting the temperature and humidity sensor 183 and the developer. To achieve such an object, the temperature and humidity sensor 183 is located on a bottom surface of the discharge pipe 181. In addition, a screw direction of the reverse conveyance portion 182*b*, which is part of the discharge screw 182 downstream of the position of the temperature and humidity sensor 183 in the conveyance direction, is set reverse to that of the forward conveyance portion 182*a*.

According to the second embodiment, the surplus developer conveyed from the discharge port 29 of the developing device 20 is pushed back by the reverse conveyance portion 182*b* of the discharge screw 182, and is stored in the detection region 180*b*. The temperature and humidity sensor 183 is arranged on the bottom surface of the discharge pipe 181 in the detection region 180*b*. Therefore, a detection surface of the temperature and humidity sensor 183 can be buried in the surplus developer. With this, the temperature and humidity sensor 183 can directly detect the temperature and humidity of the surplus developer. In a strict sense, the temperature and humidity sensor 183 detects temperature and humidity of air which is present in gaps of the surplus developer. Values of the temperature and humidity are highly correlated not only with a water content amount of the developer but also with a charge amount of the toner. Thus, herein, those are detected as the temperature and humidity of the developer.

Steps for obtaining the Vcont through use of the developing device 20 are described with reference to the flowchart illustrated in FIG. 9. The controller 70 receives a command for image formation and causes the image forming apparatus 1 to start image forming processing (Step S11). Upon the start of the image forming processing, driving of the developing device 20 is started. The controller 70 detects the relative humidity RH1 inside the discharge pipe 181 from the temperature and humidity sensor 183 (Step S12). The controller 70 sets the obtained relative humidity RH1 directly to the relative humidity RHdev (Step S13). Then, the controller 70 refers to the table to obtain the value of the Vcont based on the relative humidity RHdev (Step S14). After that, the controller 70 terminates the image forming processing (Step S15).

According to the image forming apparatus 1 of the second embodiment, the temperature and humidity sensor 183 is arranged below the discharge screw 182. Thus, the detection surface of the temperature and humidity sensor 183 can be buried in the surplus developer. Accordingly, the temperature and humidity sensor 183 can directly detect the temperature and humidity of the surplus developer. Therefore, approximation calculation for the relative humidity RHdev can be unnecessary. Thus, the humidity of the surplus developer discharged from the developing device 20 can be detected with high accuracy. With this, density fluctuation along with the environment fluctuation is restrained, thereby being capable of achieving stable image formation.

In the image forming apparatus 1 according to the second embodiment, the surplus developer located in the detection region 180*b* is pressed mainly in the conveyance direction, but not limited thereto. For example, as indicated by the imaginary lines in FIG. 8, a stirring portion 185 having a rib shape may be arranged on a rotary shaft 184 of the discharge screw 182 located in the detection region 180*b*.

A developer layer has characteristics in that a surface thereof rapidly responds to the environment fluctuation and in that an inside thereof is less likely to be adjusted in humidity as compared to the surface. In the second embodiment, when images having small image density are often output, the supply amount of developer is reduced. Thus, the surplus developer is not discharged through the discharge port 29. In this state, the surplus developer is not discharged to the discharge pipe 181, with the result that the surplus developer in the detection region 180*b* is not replaced. At this time, in view of the characteristic in that the developer inside the developer layer is less likely to be adjusted in humidity, there is a fear in that deviation in values of humidity may occur between developer being stirred and conveyed inside the developer container 21 and surplus developer in a state of not moving in the detection region 180*b*.

Therefore, the stirring portion 185 is arranged in the detection region 180*b* of the discharge screw 182. With this, along with the rotation of the discharge screw 182, the surplus developer which is present in the detection region 180*b* is stirred in a peripheral direction. Accordingly, the temperature and humidity of the surplus developer becomes more likely to be equivalent to those of the ambient environment, that is, the temperature and humidity inside the discharge pipe 181. The temperature and humidity inside the discharge pipe 181 are equivalent to the temperature and humidity inside the developer container 21. Therefore, when the temperature and humidity of the surplus developer in the detection region 180*b* is set equivalent to those of the ambient environment, they can be set close to the temperature and humidity of the developer inside the developing device 20. Also in this case, the Vcont is obtained, for example, by the steps along the flowchart illustrated in FIG. 9. With this, the humidity of the surplus developer discharged from the developing device 20 can be detected with high accuracy, and density fluctuation caused by environment fluctuation is restrained, thereby being capable of achieving stable image formation.

First Example

Figure 10:
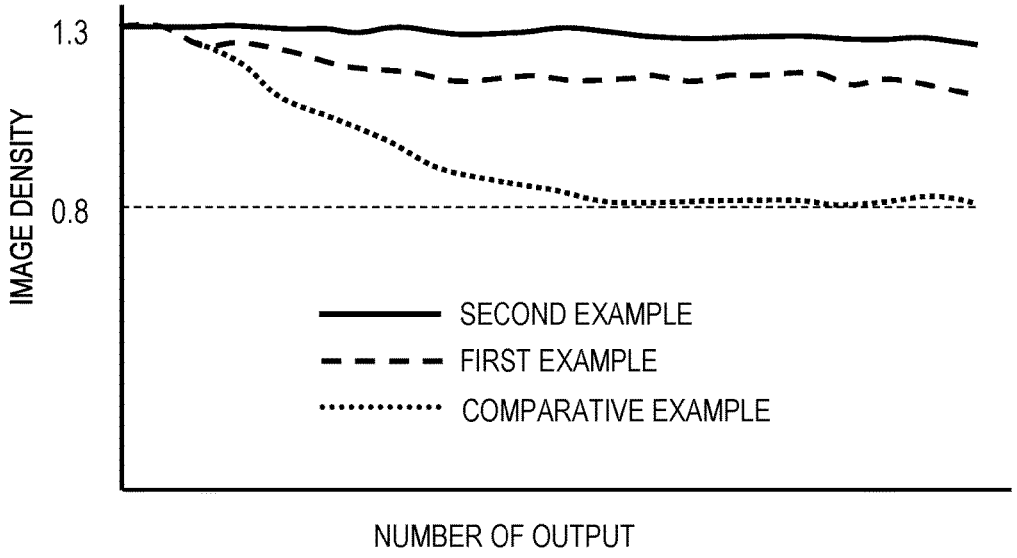
FIG. 10 is a graph for showing a relationship between the number of output and image density in an example and a comparative example.

The image forming apparatus 1 according to the first embodiment was used to perform image formation, and density fluctuation along with increase in number of output was measured. Values of image density were measured through use of a reflective spectral densitometer 500 series manufactured by X-Rite Inc. A result thereof is shown in FIG. 10. According to the first example, a control of increasing the Vcont along with increase in absolute value of charge amount of toner was executed, and hence reduction in density could be restrained.

Second Example

The image forming apparatus 1 according to the second embodiment was used to perform image formation, and density fluctuation along with increase in number of output was measured. As shown in FIG. 10, in the second example, the density fluctuation was further reduced as compared to the first example. It is conceivable that approximation calculation as used in the first example was not performed in the second example, and hence the relative humidity of the developer could be detected with higher accuracy.

Comparative Example

The image forming apparatus 1 according to the first embodiment was used to perform image formation without use of the detection result of the temperature and humidity sensor 83, and the density fluctuation along with increase in number of output was measured. As shown in FIG. 10, as the number of output and driving time were increased, and the relative humidity was reduced, the density reduction caused by the increase in absolute value of charge amount of toner has occurred.

Thus, with the image forming apparatus 1 according to the first embodiment and the second embodiment, it has been verified that the humidity of the surplus developer discharged from the developing device 20 can be detected with high accuracy, and that the density fluctuation along with the environment fluctuation can be restrained. Therefore, stable image formation can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-092669, filed May 2, 2016, which is hereby incorporated by reference herein in its entirety.

What is claimed is:

1. An image forming apparatus, comprising:

an image bearing member;

a developing device which is configured to store developer having magnetic carrier and toner and to develop an electrostatic latent image formed on the image bearing member;

a discharge port which is arranged in the developing device and through which developer is discharged from the developing device;

a collection portion which is configured to collect the developer discharged through the discharge port;

a discharge conveyance portion which is configured to convey the developer discharged through the discharge port to the collection portion;

an environment detector which is arranged in a conveyance passage of the discharge conveyance portion and is configured to detect environment information; and an adjustment portion which is configured to adjust a development condition of the developing device based on output of the environment detector.

2. An image forming apparatus according to claim 1, further comprising a conveyance member which is arranged in the conveyance passage of the discharge conveyance portion and is configured to convey developer.

3. An image forming apparatus according to claim 2, wherein the conveyance member includes:

a first conveyance portion which is configured to convey developer in a first direction toward the collection portion; and a second conveyance portion which is arranged downstream of the first conveyance portion in the first direction and is configured to convey developer in a second direction which is opposite to the first direction, and wherein the environment detector is arranged between the first conveyance portion and the second conveyance portion.

4. An image forming apparatus according to claim 3, wherein the conveyance member includes a stirring portion, which is arranged between the first conveyance portion and the second conveyance portion and is configured to stir developer in a peripheral direction of the conveyance member.

5. An image forming apparatus according to claim 2, wherein the environment detector is arranged below the conveyance member in a vertical direction.

6. An image forming apparatus according to claim 2, wherein the environment detector is arranged above the conveyance member in a vertical direction.

7. An image forming apparatus according to claim 1, wherein the adjustment portion is configured to adjust a voltage, which is applied to the developing device for developing the electrostatic latent image on the image bearing member, based on a detection result from the environment detector.

* * * * *